US006861581B2

(12) United States Patent
Geiger

(10) Patent No.: US 6,861,581 B2
(45) Date of Patent: Mar. 1, 2005

(54) ACOUSTIC GUITAR RESONATOR

(76) Inventor: John F. Geiger, 190 Berwick Dr., NW., Atlanta, GA (US) 30328

( * ) Notice: Subject to any disclaimer, the term of this patent is extended or adjusted under 35 U.S.C. 154(b) by 89 days.

(21) Appl. No.: 10/459,961

(22) Filed: Jun. 12, 2003

(65) Prior Publication Data

US 2004/0050236 A1 Mar. 18, 2004

Related U.S. Application Data

(60) Provisional application No. 60/410,696, filed on Sep. 13, 2002.

(51) Int. Cl.[7] ..... G10D 3/02

(52) U.S. Cl. ..... 84/294; 84/296; 84/291; 84/267; 84/292; 84/270

(58) Field of Search ..... 84/294, 296, 291, 84/267, 292, 270

(56) References Cited

U.S. PATENT DOCUMENTS

| | | | | |
|---|---|---|---|---|
| 1,887,861 A | * | 11/1932 | Schireson | 84/294 |
| 4,632,003 A | * | 12/1986 | Kopp | 84/723 |
| 5,780,758 A | * | 7/1998 | McGill | 84/296 |

* cited by examiner

*Primary Examiner*—Shih-Yung Hsieh
(74) *Attorney, Agent, or Firm*—Harry I. Leon

(57) ABSTRACT

A device that can be easily placed on and removed from an acoustic, stringed instrument, such as an acoustic guitar. When placed on a guitar, the device amplifies and clarifies the sound of the guitar, thereby allowing the guitarist to obtain quality sound and high volume. In addition, the device enables the guitarist control the timbre or sound characteristics of the guitar.

24 Claims, 5 Drawing Sheets

ACOUSTIC GUITAR RESONATOR

CROSS REFERENCE TO RELATED APPLICATIONS

This is a non-provisional application of the earlier filed provisional application, Ser. No. 60/410,696 filed Sep. 13, 2002 and claims the benefit of the priority of the filing date Sep. 13, 2002 pursuant to 35 U.S.C. § 119(e).

FIELD OF INVENTION

The present invention generally relates to stringed musical instruments, such as guitars and banjos, and in particular to sound resonating and amplifying devices for acoustic guitars.

BACKGROUND OF THE INVENTION

The traditional, flat-top acoustic guitar has many shortcomings despite of its immense popularity throughout the world. Some of the shortcomings are (1) low volume, (2) difficulty in achieving balanced sound, (3) the cost of a guitar with outstanding sound, (4) limited control available to the guitarist, and (5) the inverse relationship between the sound quality and volume.

While electronic amplification is possible, many guitarists appreciate and would like to own a good sounding, entirely acoustic guitar capable of great volume. In fact, there are very large guitars capable of producing loud volume; however, these are awkward to hold and play. There is a need for a guitar capable of producing quality sound at high volume, without the awkwardness accompanying very large guitars.

Conventional guitars are made to produce balanced sound for notes between the lowest fundamental tone input E2 (82.41 cycles per second, hereinafter "cps") to the highest fundamental tone input B6 (1,975.53 cps). In general, guitars with the richest and most pleasing low pitch tones often do not have the most pleasing high pitch tones, and vice versa. Some attempts to solve this problem include the use of internal resonant sound chambers, as well as internal and external metal resonating cones in so called "resonator guitars". This problem, however, has not been satisfactorily resolved as evidenced by the lack of no dominant resonant guitar type in the market. There is a need for a guitar capable of producing quality sound throughout its entire frequency range.

An inexpensive guitar with a plywood veneer top and poor sound quality can be obtained for about fifty dollars ($50.00). However, guitars with outstanding sound quality can cost many hundreds and thousands of dollars; such guitars often require fine craftsmanship and materials which are often rare and expensive. There is a need for an inexpensive acoustic guitar capable of producing quality sound.

A guitarist has limited control over an acoustic guitar's volume or its characteristic sound or timbre (hereinafter "timbre"). The guitarist may strike the strings nearer the bridge for brighter sound, use a thick pick and strike the strings harder for greater volume, and/or use strings of different gauges and materials for increased resonance and different timbre. Many guitarists often have several guitars for different qualities they seek at different times. There is a need for a guitar capable of allowing the guitarist to easily achieve different levels of volume and different sound characteristics while using the same guitar.

SUMMARY OF INVENTION

The present invention discloses devices and methods for improving the sound quality and volume of a convention guitar and allowing control over the sound characteristics thereof.

In the preferred embodiment, a resonator plate having four arms and a center section, thus generally shaped as a cross, can be placed cantilevered near the edge defining the sound hole of a conventional guitar using a detector-clip, which extends from one of the four arms. Thus placed, the resonator plate partially covers the sound hole and is beneath the plurality of guitar strings. The detector-clip (also referred to as "detector") comprises an upper prong, which is placed above the top surface of the guitar top and below the guitar strings, and two under prongs, which are placed beneath the underneath surface of the guitar top. Accordingly, the upper and under prongs perform the clipping or attaching function using the edge defining the guitar sound hole as a wedge held between them. The resonator amplifier and the detector-clip are preferably made of a single brass sheet.

The four arms of the resonator plate act as cantilevered thin brass structures, which effectively reverberate and transfer to the air the surface acoustic waves detected by pointed ends of the upper and under prongs and are routed onto the resonator plate. In the preferred embodiment, the center section is shaped substantially as a square, and each arm extending from each side of the square. Two of the four arms are preferably shaped as trapezoids and are opposite of each other, while the remaining two arms are shaped substantially as squares and extend from the opposite side of each other. Each arm preferably define at least one plate-hole, which enables the resonator plate to more efficiently amplify and transfer surface acoustic waves to the air. The detector-clip extends from the end of one of the trapezoidal arms, which trapezoidal arm is referred also as the "clip-arm".

The upper prong comprises a detector-end which is generally placed on a collector-amplifier, which is preferably placed on the top surface of the guitar top and near the sound hole, where rich surface acoustic waves are generated and available for detection and amplification. In the preferred embodiment, the detector-end is curved and angled so that it points toward the sound hole of the guitar when it is placed on the collector-amplifier. The detector-end detects or copies the surface acoustic waves from the collector-amplifier and routes them to the resonator plate, where the acoustic surface waves are further amplified and transferred to the air. Similarly, each of the under prongs also comprises a detector-end which is curved and angled so that it points toward the sound hole of the guitar when each is placed on the underneath surface of the guitar top. The detector-ends of the under prongs detect surface acoustic waves on the underneath surface of the guitar top and routes them to the resonator plate.

The collector-amplifier, preferably made of a brass sheet, comprises wider and narrower sections, and defines a first thread-hole. In the preferred embodiment, the wider section is a regular octagon and the narrower section is a rectangle which extends contiguously from one of the sides of the octagon and comprises an end portion which defines the first thread-hole. The shape and size of the collector-amplifier are designed so as to allow efficient amplification and routing of the surface acoustic waves detected or copied from the guitar top. When the collector-amplifier is placed on the guitar top near the sound hole, the end portion defining the first thread-hole hangs over the sound hole. In the preferred embodiment, the detector-end of the upper prong is placed substantially near the center of the wider section of the collector-amplifier.

The detector-clip defines a second thread-hole, which aligns with the first thread-hole when the detector-end of the upper prong of the detector-clip is placed on the collector-amplifier. An end of a feedback needle traverses through the first and second thread-holes, thereby connecting the part of the detector-clip defining the second thread-hole with the part of the narrower section of the collector amplifier defining the first thread-hole. The feedback needle, together with the collector-amplifier and the upper prong of the detector-clip forms a positive feedback loop for the surface acoustic waves traveling on the upper prong and the collector-amplifier.

A timbre piece may be placed between the collector-amplifier and the detector-end of the upper prong. The use of a timbre piece allows the guitarist to vary the timbre or the characteristic sound of a conventional guitar. A timbre piece may be made of various materials, including but not limited to wood, metal, paper and rubber, and have various shapes, including but not limited to octagons, pentagons, squares, rectangles, ovals, and circles.

The present invention achieves quality amplification of guitar sound by greatly amplifying the rich guitar sound at or near at the sound hole without affecting or adding to the force on the guitar strings. The present invention also provides means to easily insert sound characteristics of another material and shape to the sound of a conventional guitar.

DETAILED DESCRIPTION OF THE PREFERRED EMBODIMENT

Figure 1:
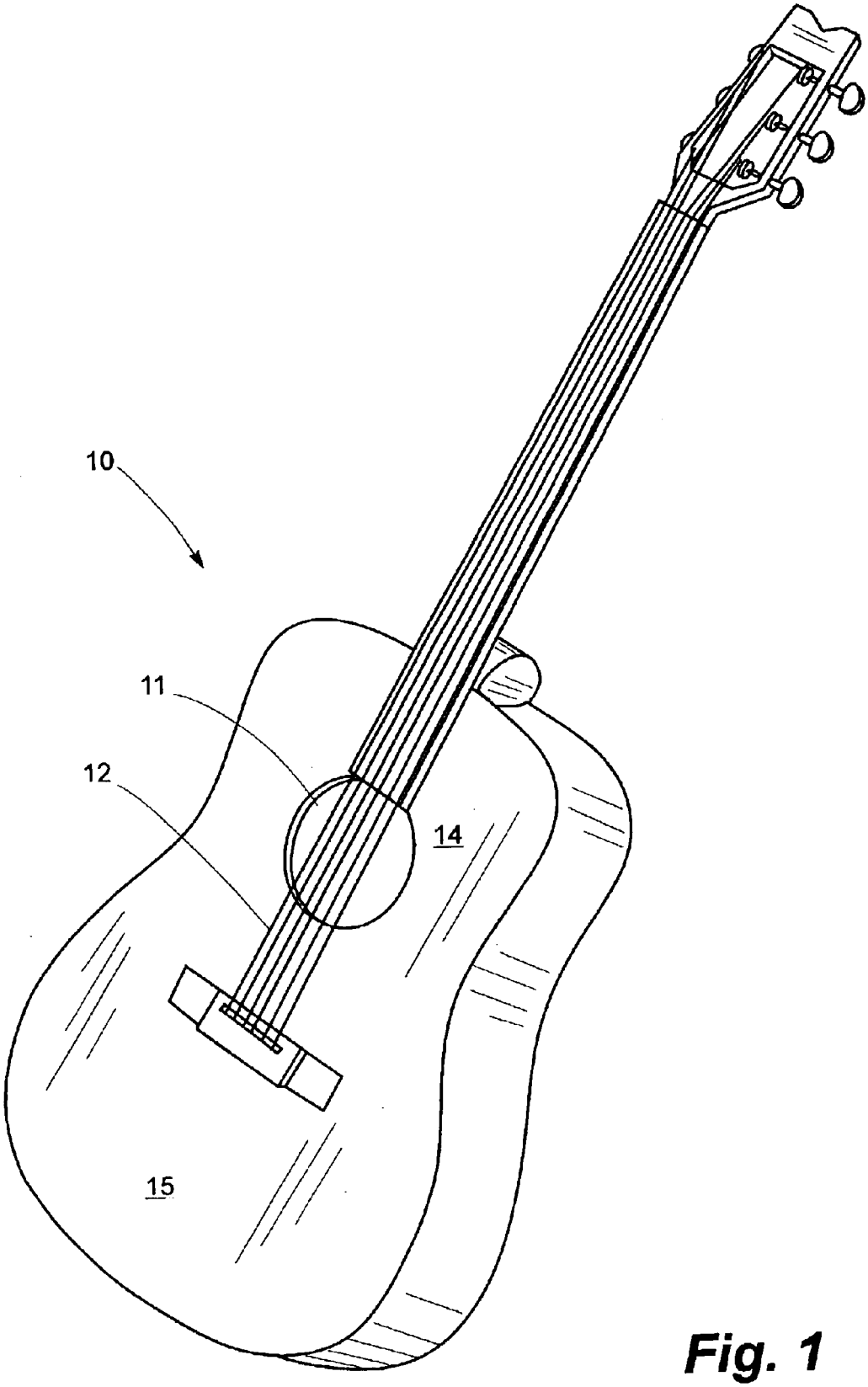
Fig. 1 Prior Art
FIG. 1 is a perspective view of a conventional acoustic guitar.

FIG. 1 illustrates conventional guitar 10 having guitar top 15 defining sound hole 11, and a plurality of strings 12. The areas immediately next to sound hole 11 and generally referred to by reference number 14 are small but active areas of sound on guitar top 15. When guitar 10 is played, surface acoustic waves (composite waves of a plurality of different frequencies) travel on the top and underneath surfaces of guitar top 15, and in particular, rich harmonics which are essential for quality sounds are found in areas 14.

Devices and methods according to the present invention provide means to detect, copy, modify, amplify and route the surface acoustic waves on areas 14 of guitar top 15 so as to enable the guitarists to obtain quality sound, high volume, and different timbre from a conventional acoustic instrument, such as guitar 10. The present invention achieves the desired results by manipulating and utilizing well known characteristics of sound propagation, such as constructive interference, reflection and diffraction, and positive feedback of sound waves.

Figure 2:
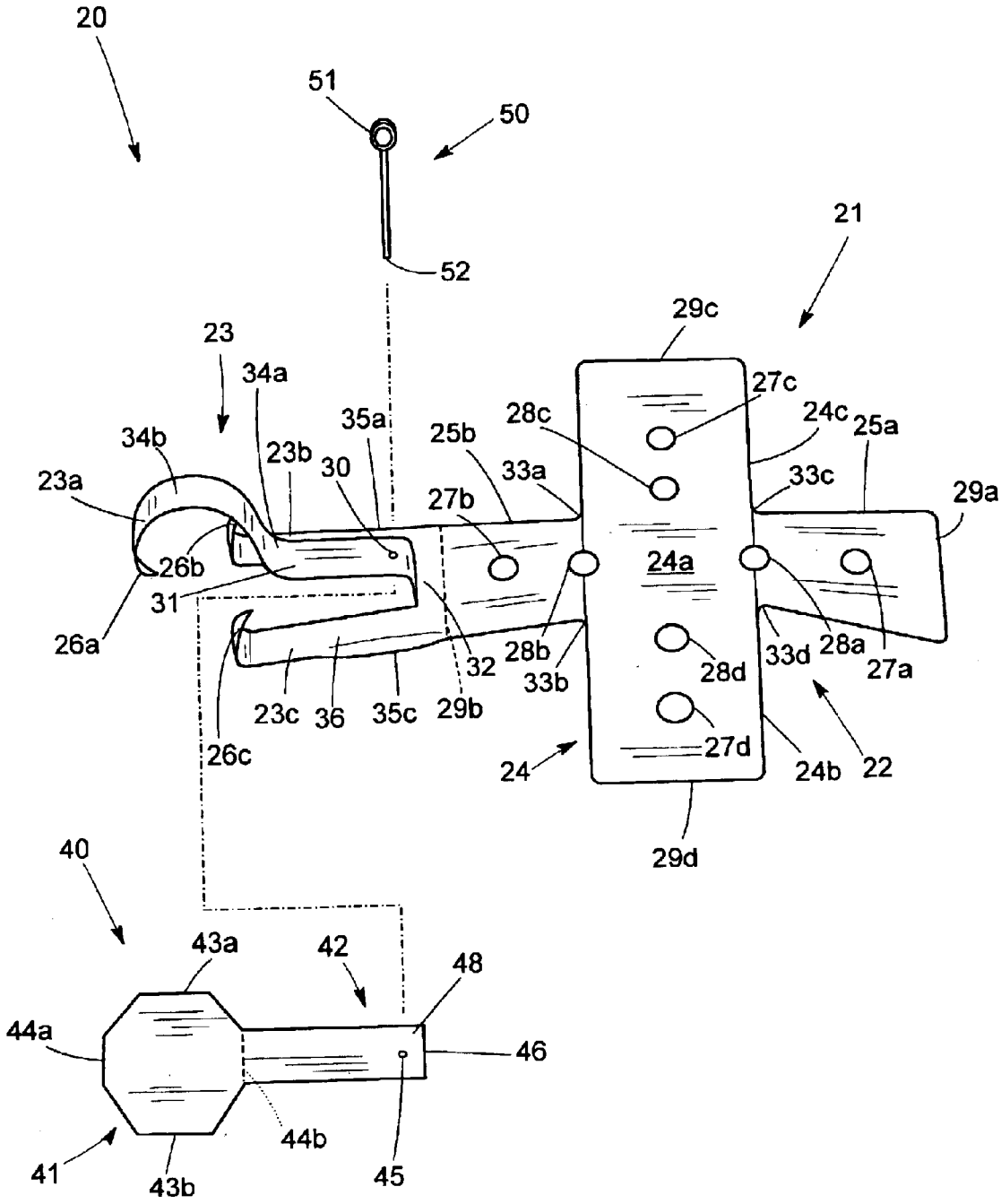
FIG. 2 illustrates an embodiment according to the present invention, comprising a resonator, a collector-amplifier and a feedback needle.

FIG. 2 illustrates embodiment 20 according to the principles of the present invention. Embodiment 20 comprises of resonator 21, collector-amplifier 40 and feedback needle 50.

Resonator 21 comprises resonator plate 22 and detector-clip 23. Resonator plate 22 comprises a center section 24*a* and four cantilevered arms 24*b*, 24*c*, 25*a*, 25*b* extending from the center section. In the preferred embodiment, center section 24*a* and arms 24*b* and 24*c* are equally sized one (1) by one (1) inch squares, and the arms extend from the opposite sides of the center section 24*a*. Thus, arms 24*b* and 24*c* and center section 24*a* form rectangle 24, whose width and length are one (1) and three (3) inches, respectively. Arms 25*a* and 25*b* are preferably shaped as trapezoids and extend from the opposite sides of the remaining two sides of the center section 24*a*. In particular, the narrower bases of the trapezoidal arms 25*a*, 25*b* are congruous to and centered about the sides from which they extend, respectively.

In the preferred embodiment, arms 25*a* and 25*b* are regular trapezoids: arm 25*a* has a height of one (1) inch, a narrower base of three-fourth (¾) of an inch, and a wider base of one (1) inch, while arm 25*b* has a height of one (1) inch, a narrower base of one half (½) of an inch and a wide base of seven-eight (⅞) of an inch. In FIG. 2, dotted line 29*b* represents the end of arm 25*b* from which detector-clip 23 extends. The shape and size of trapezoidal arms 25*a*, 25*b* are designed to facilitate channeling of surface acoustic waves traveling on resonator plate 22, e.g., collecting and combining detected surface acoustic waves and allowing them to propagate toward arm 25*a*.

In the preferred embodiment, each of four arms 24*b*, 24*c*, 25*a*, 25*b* defines two plate-holes, 27, 28, whose diameter is about three-sixteenth (3/16) of an inch. The center of the plate-holes defined by arms 24*b*, 24*c*, i.e., plate-holes 27*c*, 27*d*, 28*c*, 28*d*, align on the longitudinal axis of rectangle 24, while the centers of the plate-holes defined by arms 25*a*, 25*b*, i.e., plate-holes 27*a*, 27*b*, 28*a*, 28*b*, align on the transversal axis of rectangle 24. The center of plate-holes 27 is one half (½) of an inch away from edges 29 and from the center of plate-holes 28, respectively.

In general, arms 25*a* and 25*b* slope gently downward from center section 24*a*, while arms 24*b* and 24*c* bend slightly downward as they extend from center section 24*a* so to prevent them from rising above the guitar top 15 and injuring the guitarist's fingers when embodiment 20 is placed on guitar 10 and vigorously vibrate. Arms 24*b*, 24*c*, 25*a* and 25*b* may be adjusted with finger pressure.

In the preferred embodiment, detector-clip 23 extends from arm 25*b*, also referred to as the clip-arm. (See FIG. 2). Detector-clip 23 comprises base 32 congruous to end 29*b* (the dotted line) of clip-arm 25*b* and has prongs that may be used to place resonator 21 cantilevered near the edge defining sound hole 11.

In the preferred embodiment, the width of base 32 at end 29*b* is about seven-eighth (⅞) of an inch and splits into three prongs at end 36, shown as a dotted line, which is about on-fourth (¼) of an inch away from end 29*b*. The prongs are referred to as upper prong 23*a* and under prongs 23*b*, 23*c* and are separated from each other by one-sixteenth (1/16) of an inch. Each prong is about one-fourth (¼) of an inch wide at end 36. When laid flat, upper prong 23*a* is about two (2) inches long, while under prongs 23*b*, 23*c* are about one (1)

inch long, each. Each prong 23 starts to taper about one-fourth (¼) of an inch away from the end thereof and forms pointed detector-end 26, which lies on the longitudinal axis of the prong. Upper prong 23*a* defines a thread-hole 30 whose diameter is one thirty-second (1/32) of an inch. The center of thread-hole 30 aligns with the transversal axis of rectangle 24 and is about three-eighth (⅜) of an inch from end 36.

Figure 4:
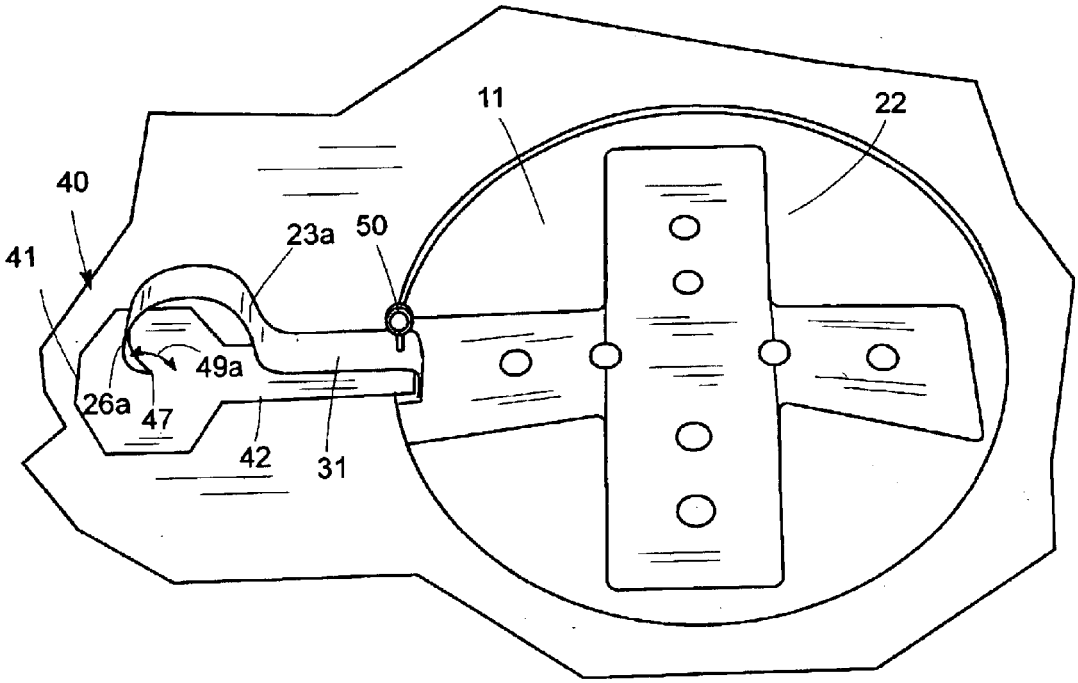
FIG. 4 is the perspective view of the top surface of the guitar top, particularly illustrating the contact between the collector-amplifier and the upper prong of the resonator, as well as the resonator being placed on the guitar using the edge defining the sound hole of a conventional guitar.

In general or when in use, upper prong 23*a* is curved upward so that only certain parts of upper prong 23*a* would touch a flat surface. In the preferred embodiment, upper prong 23*a* starts to curve smoothly upward at or near point 34*a*, about three-eighth (⅜) of an inch away from the center of thread-hole 30 and starts to curve smoothly downward at or near point 34*b*, about seven-eighth (⅞) of an inch away from the center of thread-hole 30. Near the end of the prong or about one-fourth of an inch from detector-end 26, prong 23*a* curves backward so that detector-end 26*a* touches a flat surface at an angle ranging between ninety-five to one hundred (95–100) degrees and points toward sound hole 11. (See FIG. 4, angle 49*a*). This range for the contact angle between detector-end 26*a* and the surface of the collector-amplifier 40 helps to produce a pleasant sharp sound from the guitar 10, while the same angle less than ninety-five (95) degrees produces a less pleasing sound and lower volume. The portion of upper prong 23*a* between end 36 and about one-sixteenth (1/16) of an inch before thread-hole 30 (reference number 34*c*) is bent vertically, while the portion between 34*c* and 34*a* is shaped so that it lies flat or substantially flat on a horizontal surface.

Figure 5:
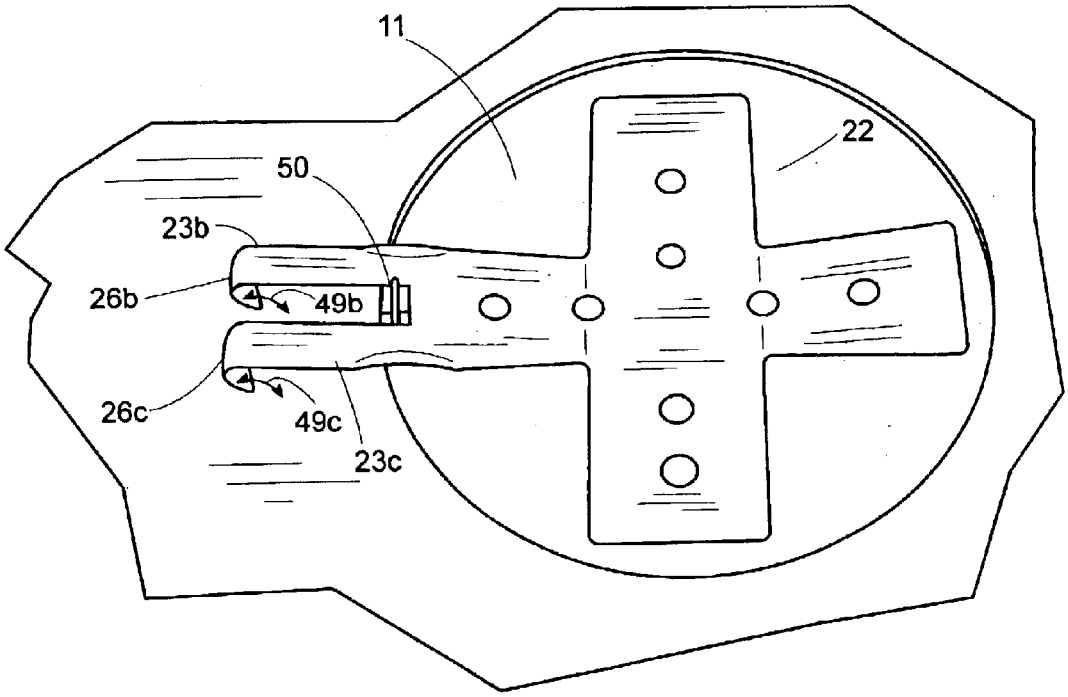
FIG. 5 is the perspective view of the underneath surface of the guitar top, particularly illustrating the contact between the under prongs of the resonator and the underneath surface of the guitar top, as well as the resonator being placed using the edge defining the sound hole of a conventional guitar.

With respect to under prongs 23*b* and 23*c*, portions of the prongs near the end thereof are curved upward and backward so that each detector-end 26*b*, 26*c* touches a flat surface or the underneath surface of the guitar top 15 at an angle of approximately 30 degrees and points toward the sound hole. (See FIG. 5, angles referenced as 49*b*, 49*c*). This angle of contact between detector-end 26*b* or 26*c* and the underneath surface of the guitar top 15 facilitates placing embodiment 20 cantilevered on guitar 10 and allows efficient copying of the surface acoustic waves from the underneath surface of guitar top 15 onto the underside of resonator plate 22. In addition, about one-eighth (⅛) of an inch of the outer edges 35*a* and 35*b* of the under prongs, starting at or near end 29*b* and ending at or near end 36, bends slightly downward at approximately thirty (30) degrees to stiffen the under prongs and enhance their clipping or grapping function. The adjustment for detector-ends 26 can be easily made with a pair of needle-nose pliers.

Collector-amplifier 40 comprises a wider section 41 and a narrower section 42. In the preferred embodiment, wider and narrower sections 41 and 42 are formed from a single piece whose shape can be formed from a regular octagon and a rectangle extending from a side of the octagon. However, different shapes may be used for the wider and narrower sections of the collector-amplifier.

In the preferred embodiment, the distance between edges 43*a* and 43*b* of the wider section 41 is about one (1) inch, as is the distance between edges 44*a* and 44*b*. The width of the narrower section 42 is about one-fourth (¼) of an inch and aligns with the transversal axis cutting cross edges 44*a* and 44*b*. The length of the narrower section 42 is about three-fourth (¾) of an inch and defines a thread-hole 45 whose diameter is about one-thirty seconds (1/32) of an inch. The center of thread-hole 45 aligns with the transversal axis cutting across edges 44*a* and 44*b*, and the distance between the center of thread-hole 45 and edge 46 is about one-sixteenth (1/16) of an inch.

Figure 3:
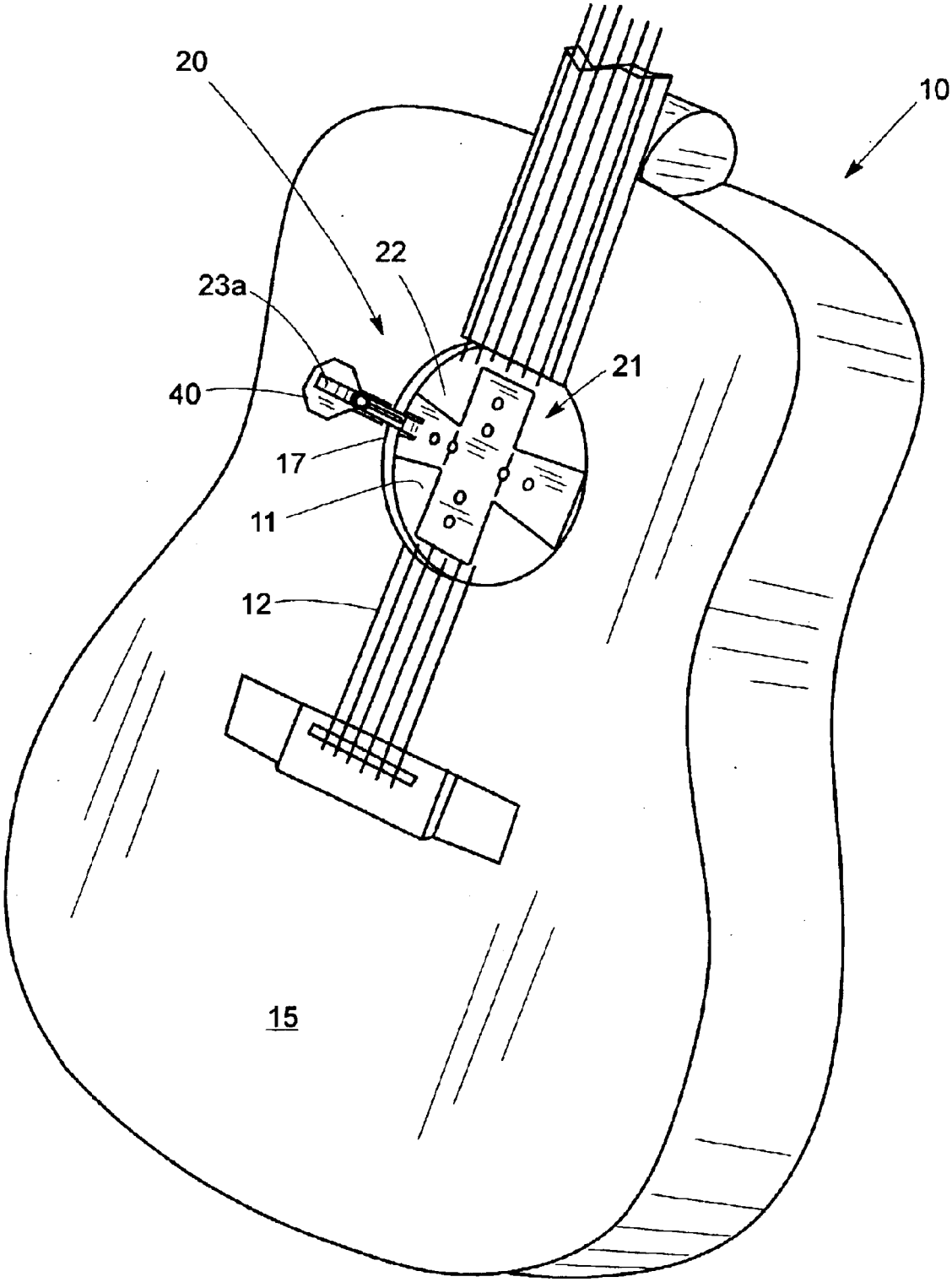
FIG. 3 illustrates the embodiment shown in FIG. 2 being used with a conventional guitar.

Feedback needle 50 is typically a metallic pin, made out of nickel coated steel having one coiled end 51 and the other end 52. Feedback needle 50 connects resonator 21 and collector-amplifier 40 when these pieces are placed for use near an edge defining the sound hole of guitar 10. (See FIG. 3). In particular, end 52 of feedback needle 50 traverses through and its surface touches the edges defining thread-holes 30 and 45. It is important to place the collector-amplifier 40 on guitar top 15 and align thread-holes 30 and 45 so that feedback needle 50 does not touch the edge defining sound hole 11 as it traverses through thread-holes 30 and 45.

Resonator 21 is typically made of a single piece of brass sheet, whose thickness preferably ranges between 0.010 to 0.016 inches. Collector-amplifier 40 is typically made of a single piece of brass sheet, whose thickness is preferably about 0.010 inches. The brass sheet used for resonator 21 and collector-amplifier 40 is preferably one-half (½) to three-fourth (¾) hard brass, typically having a composition of seventy percent (70%) copper (Cu) and thirty percent (30%) zinc (Zn).

The sound quality produced when embodiment 20 is placed on guitar 10 depends on efficient transfer (i.e., minimal or insignificant energy loss and distortion) of the surface acoustic waves on guitar top 15 near sound hole 11 to the air. Embodiment 20 efficiently transfers the waves because, among other things, it is made from thin, contiguous metal (thin brass sheet) wherever possible, without using solder, and by minimizing contact areas to points, lines or small areas whenever a part of the embodiment contacts another part thereof, e.g., the point contact between detector-end 26*a* and the surface of collector-amplifier 40.

In use, resonator 21 is placed cantilevered at or near the edge defining sound hole 11, partially covering the sound hole. (See FIG. 3). In general, the user places resonator plate 22 underneath guitar strings 12 and clips or attaches detector-clip 23 to the surfaces of guitar top 15 near edge 17, which is the upper edge defining sound hole 11 when guitar 10 is held horizontally, the typical way a guitarist would hold the guitar. In placing resonator 21 on guitar 10, the user is recommended to gently handle prongs 23 so they would not harm the guitar body.

In placing embodiment 20 on guitar 10, upper prong 23*a* is placed on collector-amplifier 40, which is placed on the top surface of guitar top 15 near edge 17, while under prongs 23*b*, 23*c* are placed on the underneath surface of guitar top 15. Thus, the clipping function of resonator 21 is achieved by using the edge defining sound hole 11 as a wedge held between the space formed by upper prong 23*a* and under prongs 23*b*, 23*c*. Collector-amplifier 40 is placed on the top surface of guitar top 15 such that edge 46 and portion 48 defining thread-hole 45 hangs over edge 17.

Once collector-amplifier 40 is placed at a desired place, resonator 21 and collector-amplifier 40 are aligned so that thread-holes 30 and 45 align, the narrower section 42 is beneath and aligns with the flat portion 31, and detector-end 26*a* is placed on or substantially near the center 47 of the wider section 41. Feedback needle 50 is inserted through aligned thread-holes 30 and 45, thereby connecting resonator 21 and collector-amplifier 40 and forming a feedback loop for the surface acoustic waves detected by detector-end 26 and traveling on upper prong 23*a*. Embodiment 20 so placed on guitar 10 works well as a sound amplifier because wavelengths of the guitar's fundamental frequencies and most of their significant harmonies are sufficiently long such that waves detected at multiple points in close proximity on guitar top 15 can be considered almost in phase.

Operational aspects of embodiment 20 are provided below from two perspectives: (1) a high frequency perspective and (2) a low frequency perspective. From the high frequency perspective, the sound from guitar 10 can be viewed essentially as surface acoustic waves that are copied from top and underneath surfaces of guitar top 15 to the brass surfaces of resonator 21 and collector-amplifier 40. In general, acoustic waves on a first surface are copied or transferred to another surface by physical contact of between the two surfaces. For accurate sound reproduction, sound waves are copied with a very small detector area in the manner of a gramophone or phonograph needle. Embodiment 20 accurately copies surface acoustic waves on guitar top 15 because any contact or interfaces between two different surfaces are made sufficiently small vis-a-vis the wavelengths of the guitar's fundamental frequencies and their major harmonics.

When a guitarist strikes one or more strings on guitar 10 and embodiment 20 is placed or attached thereto, the surface acoustics waves on the guitar top 15 are copied, amplified, and routed to the top and bottom surfaces of resonator plate 22, which efficiently transfers the waves to the air because of, among other things, its shape and material. In this copying and amplifying of the guitar's sound, the wider section 41 is designed to allow reverberation of the acoustic waves between its parallel edges and allow combination and amplification of similar frequencies. Feedback needle 50 in the path of the acoustic waves causes reflection of the waves, providing positive feedback and further amplification. Plate-holes 27 and 28 in the path of the surface acoustic waves cause further reverberation and efficient transfer of the waves to the air.

Cantilevered arms 24*b*, 24*c* are particularly useful for amplification of lower frequencies among the composite frequencies making up a note or sound because lower frequencies can diffract or bend around corners 33*a* and 33*b* and reverberate between the parallel edges of arms 24*b*, 24*c* (also referred to collectively as "low frequency arms"). The low frequency reverberation increases in amplitude at or near edges 29*c* and 29*d* because of the boundary effect, and thus, amplified lower frequencies are efficiently transferred to the air according to the present invention.

Cantilevered arm 25*a* is particularly useful for amplification of higher frequencies among the composite frequencies making up a note or sound because higher frequencies tend to travel or flow over the center section 24*a* and pass far corners 33*c*, 33*d* with an insubstantial amount of unwanted wave reflection. The high frequency reverberation increases in amplitude at or near edge 29*a*, and thus amplified higher frequencies are efficiently transferred to the air according to the present invention.

From the low frequency perspective, the body of guitar 10 (including guitar top 15 with sound hole 11, sides and back) is a mechanical system which functions as an air resonant sound chamber. When embodiment 20 is placed on guitar 10, a new system is formed in which embodiment 20 functions as a positive feedback loop which amplifies the sound. Embodiment 20 acts a positive feedback loop because detector-clip 23 acts in tandem with guitar top 15, that is, an upward motion of guitar top 15 causes an upward motion of detector-clip 23. Thus, detector-clip 23 acts as a lever and causes resonator 21 to pivot about its fulcrum, i.e., edge 17. This pivoting causes resonator plate 22 pivot downward, which motion increases the air pressure in the resonant chamber which further increases the upward motion of guitar top 15 and so on until other forces stop the cycle. It is believed that this pumping action on the air within guitar 10 is a major reason for the excellent low tones achieved by the present invention.

If embodiment 20 becomes loose on guitar 10, it should be removed from the guitar, adjusted and returned to its former position. Removal is accomplished by removing feedback needle 50 and collector-amplifier 40 and pressing downward on the resonator plate 22 while pushing detector-clip 23 away from its points of attachment. The downward pressure on the resonator plate 22 frees detector-ends 26*b* and 26*c* from the underneath surface of guitar top 15. When detector-ends 26*b* and 26*c* appear in sound hole 11, resonator 21 can be withdrawn from beneath the strings 12. Tension in detector-clip 23 may be restored by squeezing under prongs 23*b* and 23*c* upward with fingers, and, at the same time, squeezing upper prong 23*a* downward.

Figure 6:
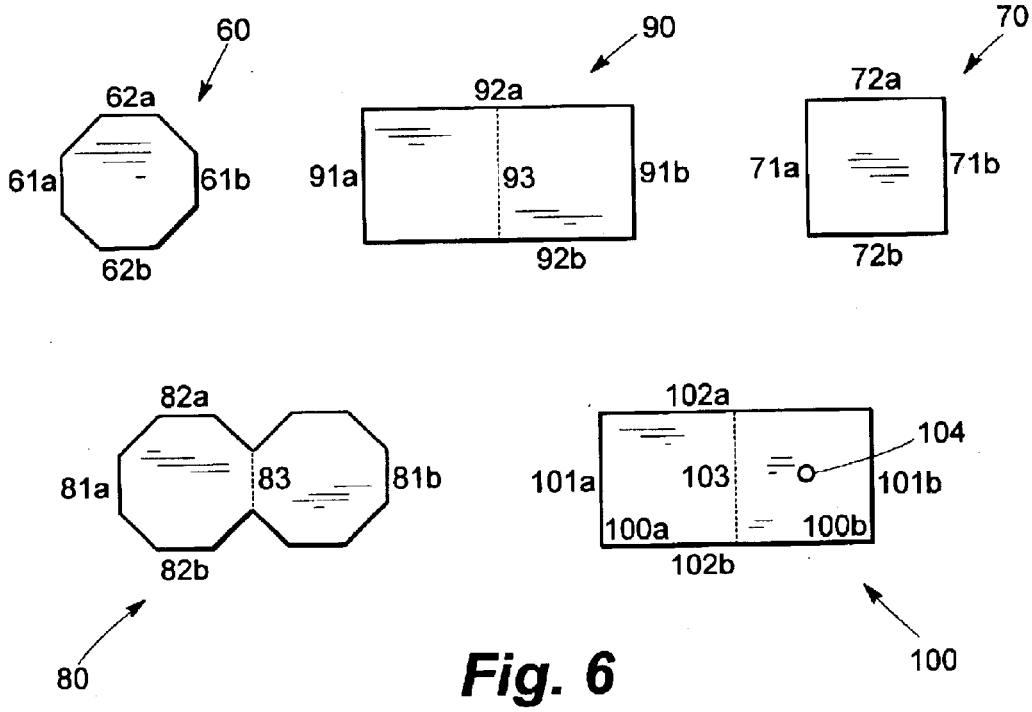
FIG. 6 illustrates exemplary timbre pieces that may be used with the embodiment shown in FIG. 2.

Embodiment 20 may also be used with a timbre piece to modify the timbre of guitar 10. FIG. 6 illustrates a plurality of timbre pieces 60 through 100 which may be used to affect the timbre. For octagonal timbre piece 60, the height and width (the distance between 61*a* and 61*b* and that between 62*a* and 62*b*, respectively) are about one (1) inch, each. For square timbre piece 70, the width and height (the distance between 71*a* and 71*b* and that between 72*a* and 72*b*, respectively) range between one (1) to one and a quarter (1¼) inches. For timbre piece 80, the width and height (the distance between 81*a* and 81*b* and the distance between 82*a* and 82*b*, respectively) are about two (2) and one (1) inch(es), respectively. When in use, timbre piece 80 is folded along dotted line 83, creating folded double octagons connected along line 83. For timbre piece 90, the width and height (the distance between 91*a* and 91*b* and that between 92*a* and 92*b*, respectively) are about two (2) and one (1) inch(es), respectively. When in use, timbre piece 90 is folded along dotted line 93, creating folded double squares connected along line 93. For timbre piece 100, the width and height (the distance between 101*a* and 101*b* and that between 102*a* and 102*b*, respectively) are about two (2) and one (1) inch(es), respectively. Square section 100*b* defines hole 104 having a diameter of three thirty-second (3/32) of an inch at or near the center thereof. When in use, timbre piece 100 is folded along the dotted line 103, creating folded double squares connected along line 103. Typically, square section 100*b* is used as the top surface on which detector-end 26*a* is placed near hole 104. Timbre pieces 60 through 100 may be made from various materials, including brass of varying thickness, maple and mahogany veneers, balsa wood, corrugated card boards, and wide rubber bands. In addition, different shapes such as ovals, circles and pentagons may be used. However, in testing different timbre pieces, the shapes shown in FIG. 6 yielded most pleasing results; in particular, a square-shaped timbre piece larger than one (1) inch gave excellent low frequency results at the expense of high frequencies.

Figure 7:
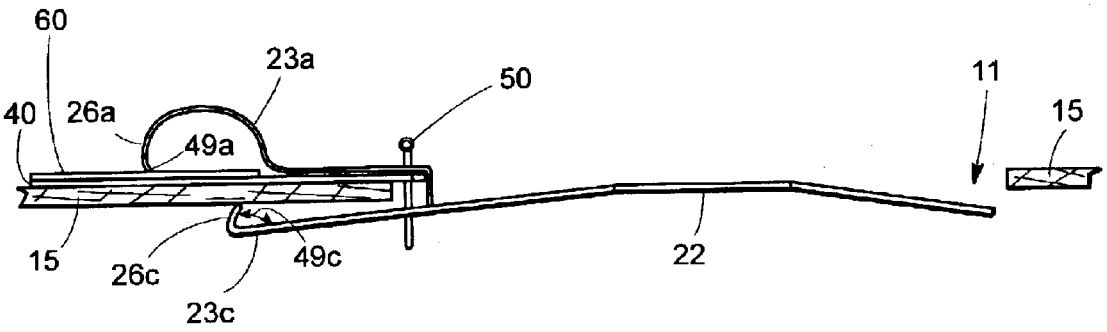
FIG. 7 is the side view of the guitar top illustrating particularly a timbre piece being placed between the collector-amplifier and the detector-clip of the resonator.

When in use, for example, timbre piece 60 is inserted between collector-amplifier 40 and detector-clip 23. (See FIG. 7). Accordingly, the surface acoustic waves on guitar top 15 travel or flow into and over timbre piece 60 and thus are modified by the sound characteristics of timbre piece 60 before being detected by detector-end 26*a*. More particularly, the surface acoustic waves from guitar top 15 move or travel on or through timbre piece 60, causing timbre piece 60 to vibrate and add its timbre to the sound of guitar 10. Thus, the shape, thickness, and material of the timbre pieces influence the resulting sound.

The nature of the start tone (also referred as "impact" timbre) is an important sound characteristic, which depends on the steepness of the tone as it begins. Musical instruments with strong or high impact timbre include drums, horns such as trumpets, vibes and banjos. Strong impact timbre, highly desirable in jazz as well as in other styles of music, is provided to guitar 10 when embodiment 20 is placed thereto without a timbre piece. However, a different degree of impact timbre can be added to the sound of guitar 10 when an octagon- or square-shaped timbre piece made out of a brass sheet with 0.010 inch thickness is used together with embodiment 20. In general, impact timbre becomes stronger when a thicker or stiffer material is used for the timbre piece, whereas the same becomes weaker when a less stiff material, such as very thin brass or wood veneers, is used for the timbre piece. Accordingly, the present invention enables guitarists to easily and quickly control the impact timbre of an acoustic instrument, such as guitar 10.

The following list summarizes some of the experimental results of using a timbre piece made out of different materials and shapes in between collector-amplifier 40 and detector-clip 23.

1. When a timbre piece is folded double octagons, e.g., 80 in FIG. 6, comprising of thin brass, having 0.005 inch thickness, folded and compressed into double octagons joined along one edge, the resulting sound of guitar 10 is very loud and has a bright metallic tone and the resonant characteristics of a conventional resonator guitar.

2. When a timbre piece is folded double squares, e.g., 90 in FIG. 6, comprising of thin brass, having 0.005 inch thickness, folded and compressed double squares of one (1) and one-eighth (1/8) by one (1) and one-eighth (1/8) inches and joined along one edge, the resulting sound of guitar 10 is very loud and metallic, although it is less distinct than the sound resulting when a folded octagon timbre piece, i.e., described in the first paragraph of this list, is used.

3. When a timbre piece is as described in the second paragraph of this list but with a hole having a 1/32 inch diameter at or near the center of the top surface, e.g., 100 in FIG. 6, and when detector-end 26*a* of upper prong 23*a* is placed near hole 104, the resulting sound of guitar 10 is louder than the sound resulting when a folded-square timbre piece, i.e., that described in the second paragraph of this list, is used.

4. When a timbre piece is a brass octagon having a thickness of 0.016 inch, the resulting sound of guitar 10 is extremely loud and has a high-impact, banjo-like tone.

5. When a timbre piece is a maple veneer octagon having a thickness of one-thirty seconds (1/32) of an inch, the resulting sound of guitar 10 is moderately loud and has crisp, wooden and pleasing characteristics.

6. When a timbre piece is a mahogany veneer octagon having a thickness of one-thirty seconds (1/32) of an inch, the resulting sound of guitar 10 is moderately loud and has mellow, wooden and pleasing characteristics.

7. When a timbre piece is a balsa wood octagon having a thickness of one-sixteenth (1/16) of an inch, the resulting sound of guitar 10 is moderately loud and has mellow, wooden and pleasing characteristics.

8. When a timbre piece is a corrugated cardboard square having a thickness of three-thirty seconds (3/32) of an inch, the resulting sound of guitar 10 has soft, mellow and pleasing low volume characteristics.

9. When a timbre piece is a section from wide rubber band, the resulting sound of guitar 10 is very quiet, pleasing and excellent for low volume.

The sound quality described in the above list will of course vary depending on the listener. Furthermore, unless noted otherwise, detector-end 26 is placed at or substantially near the center of the timbre piece. Many different materials and shapes other than those listed herein may be used as a timbre piece.

Numerous modifications to and alternative embodiments of the present invention will be apparent to those skilled in the art in view of the foregoing description. Accordingly, this description is to be construed as illustrative only and is for the purpose of teaching those skilled in the art the best mode of carrying out the invention. Details of the embodiment may be varied without departing from the spirit of the invention, and the exclusive use of all modifications which come within the scope of the appended claims is reserved.

What is claimed is:

1. A device for improving sound quality of an acoustic guitar having a plurality of strings and a guitar top defining a sound hole, said guitar top having top and underneath surfaces, comprising:

a resonator plate having a center section and four arms extending from the center section, one of the four arms being a clip-arm;

a detector-clip extending contiguously from the clip arm and comprising an upper prong and at least one under prong;

wherein the upper prong is placed above the top surface of the guitar top and the under prong is placed beneath the underneath surface of the guitar top such that the clip-arm is near an edge defining the sound hole and the resonator plate partially covers the sound hole and is beneath the guitar strings.

2. The device according to claim 1, wherein the resonator plate and the detector-clip are made from brass.

3. The device according to claim 1, wherein the center section is substantially shaped as a square, and each of the four arms extends from each side of the square; and wherein the clip-arm and the arm on the opposite side of the clip-arm are shaped as trapezoids; and each of the remaining two arms is shaped substantially as a square having a size equal to that of the center section.

4. The device according to claim 1, wherein each arm defines at least one plate-hole.

5. The device according to claim 1, wherein the detector-clip comprises two under prongs, and each of the upper and under prongs comprises a detector-end which points toward the sound hole.

6. The device according to claim 1 further comprising:

a collector-amplifier being placed on the top surface of the guitar top and beneath the upper prong.

7. The device according to claim 6 wherein the collector-amplifier comprises a wider section having a first side from which a narrower section extends; and wherein the upper prong comprises a detector-end which is placed substantially near the center of the wider section.

8. The device according to claim 7 further comprising:

a feedback needle; and wherein the narrower section defines a first thread-hole and the upper prong defines a second thread-hole; the first and second thread-holes being aligned and the feedback needle traversing through the first and second thread-holes.

9. The device according to claim 7, wherein the wider section is shaped as an octagon and the narrower section is shaped as a rectangle; and wherein one of the shorter sides of the rectangle extends from and is smaller than the first side of the wider section.

10. The device according to claim 6, wherein the collector-amplifier is made from brass.

11. The device according to claim 6, wherein a timbre place is placed between the collector-amplifier and the upper prong.

12. An improved acoustic guitar of the type having a plurality of guitar strings and a guitar top defining a sound hole, wherein the improvement comprises:

a collector-amplifier being placed on the top surface of the guitar top near the sound hole and beneath the guitar strings; and a resonator comprising a resonator plate having a plurality of sides and a detector extending contiguously from one of the sides of the resonator plate and comprising at least one detector-end, wherein the resonator plate partially covers the sound hole and is beneath the strings and the detector-end is placed on the collector-amplifier.

13. The improvement according to claim 12, further comprising a feedback needle having two ends; wherein the collector-amplifier comprises an end portion defining a first thread-hole; said end portion hanging over an edge of the guitar top defining the sound hole;

the detector defines a second thread-hole aligned with the first thread-hole; and one end of the feedback needle traverses through the first and second thread-holes without touching the edge defining the sound hole.

14. The improvement according to claim 12, wherein the detector comprises two additional detector-ends, being placed beneath the underneath surface of the guitar top.

15. The improvement according to claim 12, wherein the resonator plate has a plurality of arms extending from the plurality of the sides; each arm defining at least one plate-hole.

16. The improvement according to claim 15, wherein the resonator plate and the collector-amplifier are made from brass.

17. The improvement according to claim 12, wherein a timbre piece is place between the collector-amplifier and the detector-end.

18. An improved acoustic guitar of the type having a plurality of guitar strings and a guitar top defining a sound hole, wherein the improvement comprises:

a collector-amplifier having an end portion defining a first thread-hole; said collector-amplifier being placed on the top surface of the guitar top near the sound hole and beneath the guitar strings so that the end portion hangs over an edge of the guitar top defining the sound hole;

a resonator comprising a resonator plate and a detector; said detector defining a second thread-hole and comprising at least one detector-end, and the resonator being placed so that the detector end is placed on the collector-amplifier, the second thread-hole is aligned with the first thread-hole, and the resonator plate is beneath the strings and partially covers the sound hole; and a feedback needle traversing the first and second thread-holes.

19. The improvement according to claim 18, wherein the collector-amplifier and the resonator are made from brass.

20. The improvement according to claim 18, wherein the resonator plate has a plurality of arms extending from a plurality of sides; and the detector extends contiguously from one of the arms and comprises two additional detector-ends being placed beneath the undersurface of the guitar top.

21. The improvement according to claim 20, wherein each of the arms defines at least one plate-hole.

22. The improvement according to claim 21, wherein a timbre piece is placed between the collector-amplifier and the detector-end.

23. The improvement according to claim 18, wherein the resonator plate has four arms extending from four sides of a central section shaped substantially as a square; two of the four arms being shaped as trapezoids and extending from two opposite sides of the central section; and the remaining two of the four arms being shaped substantially as squares and extending from the remaining two opposite sides of the central section; and the detector extending contiguously from one of the two trapezoidal arms.

24. The improvement according to claim 18, wherein a timbre piece is placed between the collector-amplifier and the detector-end.

* * * * *